United States Patent [19]

Beauregard

[11] Patent Number: 4,926,608

[45] Date of Patent: May 22, 1990

[54] ROOFING PANEL

[75] Inventor: Albert Beauregard, Hull, Canada

[73] Assignee: Ideal Roofing Company Ltd. Manufactures, Ottawa, Canada

[21] Appl. No.: 349,518

[22] Filed: May 9, 1989

[30] Foreign Application Priority Data

May 30, 1988 [CA] Canada ..... 568153

[51] Int. Cl.[5] ..... E04D 1/00

[52] U.S. Cl. ..... 52/522; 52/529; 52/542

[58] Field of Search ..... 52/522, 524, 537, 542, 52/478

[56] References Cited

U.S. PATENT DOCUMENTS

| | | | |
|---|---|---|---|
| 3,135,070 | 6/1964 | Waring et al. | 52/522 X |
| 3,481,094 | 12/1969 | Taylor | 52/522 X |
| 3,780,483 | 12/1973 | Mattes | 52/542 X |
| 4,217,741 | 8/1980 | Cole | 52/537 X |
| 4,271,653 | 6/1981 | Buchhorn | 52/522 |

FOREIGN PATENT DOCUMENTS

| | | | |
|---|---|---|---|
| 2160623 | 6/1973 | Fed. Rep. of Germany | 52/529 |

*Primary Examiner*—David A. Scherbel
*Assistant Examiner*—Lan Mai
*Attorney, Agent, or Firm*—Berman, Aisenberg & Platt

[57] ABSTRACT

There is provided a new and useful roofing panel comprising an elongated thin rectangular body section having first and second longitudinal edges and respective first and second longitudinal upstanding ribs of inverted channel configuration adjacent the edges; wherein the first rib has an inner side thereof remote from the first longitudinal edge, and the bottom section of the inner side is formed to a position approximately parallel to the body section and spaced therefrom to form an inwardly facing slot adjacent the body section; and wherein the second rib has a first outer side the bottom section of which includes the second edge and which bottom section is formed to a position substantially coplanar with the body section to form an inwardly facing flange; whereby when a first panel is placed adjacent a second panel, the second rib of the second panel fits over the first rib of the first panel and the flange is then housed in the slot.

26 Claims, 1 Drawing Sheet

ROOFING PANEL

This application relates to roofing panels.

BACKGROUND OF THE INVENTION

For a very long period of time roofing panel manufacturers have attempted to provide panels which must deal with a number of problems related to materials used, installation costs and performance after installation. A major problem area has always been in providing edge joints between roofing panels which will meet a number of important criteria as discussed below.

Difficulties pertaining to materials used have tended to change with the availability of materials and current architectural trends. For example, the light sheet metal which is currently widely used presents much different considerations from those which applied to heavier metal panels. For example, the edge treatment of the light metal panels must be roll formable rather than extruded. Many older edge treatments are not roll formable.

The strength and integrity of the edge joints between panels is clearly a very important consideration. The joint in particular must be such that it will not inherently give a loose joint nor will it over a period of time result in a loosening of the joint. As above, this aspect requires a much different treatment in dealing with light metal panels.

Furthermore, not only must the joint be physically strong, it must also be of such a nature as to be weather tight. This is of course of particular significance in the roofing context.

Labour costs are a major factor in construction and the ease and speed of installation are further important factors. The edge treatment of the panels is a key consideration in this regard.

Finally, all of the above requirements must be met while still providing a finished roof which is aesthetically pleasing.

These factors are not always easily reconciled. For example, light metal is relatively weak and particular attention must therefore be given when using that material to the strength of the joint.

To date a completely satisfactory joint for use with light metals has not become available.

Against this background the present invention provides a roof panel having an edge treatment which produces a joint which meets the above criteria.

PRIOR ART

There has been an ongoing development effort over a long period of years which is aimed at producing a roof panel which satisfactorily deals with the problems set out above. As well, there has been development in wall and similar panels, although the problems associated with those panels tend to be different from those pertaining to roofing panels.

The following Canadian patents deal with various aspects of the edge treatment of panelling:

| U.S. Pat. No. | Issue Date | Patentee |
|---|---|---|
| 80,137 | 1903 | Kendry |
| 89,364 | 1904 | Spiers |
| 615,820 | March 7, 1961 | Reynolds Metals Company |
| 860,565 | January 12, 1971 | Armco Steel Corporation |

-continued

| U.S. Pat. No. | Issue Date | Patentee |
|---|---|---|
| 94,122 | February 5, 1974 | Alcan Research and Development Limited |
| 1,021,129 | November 22, 1977 | Intercontinental Truck Body Manufacturing Ltd. |
| 1,140,722 | February 8, 1983 | Braden Steel Corporation |
| 1,201,265 | April 3, 1986 | Robertson (H.H.) Inc. |

The following United States patents are also of interest:

| U.S. Pat. No. | Issue Date | Patentee |
|---|---|---|
| 2,159,136 | May 23, 1939 | Delk |
| 2,918,996 | December 29, 1959 | Brown |
| 3,085,367 | April 16, 1963 | Ridder, et al. |
| 3,606,720 | September 21, 1971 | Cookson |
| 3,906,696 | September 23, 1975 | Poter, et al. |
| 4,223,503 | September 23, 1980 | Hague |
| 4,522,007 | June 11, 1985 | Oehlert |

All of this prior art suffers from a number of defects which make it less than ideal for the purpose intended. For example, in a number of cases the panels are intended to be extruded, and the edge treatment is not roll formable. Many of the edge treatments proposed have very little strength and poor weather resistance. Others are difficult and time consuming in installation. Still others are simply too complicated in formation and use to be of practical value.

SUMMARY OF THE INVENTION

An edge treatment has now been developed which is directed at the solution of the problems discussed above. The invention is particularly applicable to light metal roofing panels.

Thus, the invention provides in a first embodiment a roofing panel comprising an elongated thin rectangular body section having first and second longitudinal edges and respective first and second longitudinal upstanding ribs of inverted channel configuration adjacent the edges; wherein the first rib has an inner side thereof remote from the first longitudinal edge, and the bottom section of the inner side is formed to a position approximately parallel to the body section and spaced therefrom to form an inwardly facing slot adjacent the body section; and wherein the second rib has a first outer side the bottom section of which includes the second edge and which bottom section is formed to a position substantially parallel to the body section to form an inwardly facing flange; whereby when a first panel is placed adjacent a second panel, the second rib of the second panel fits over the first rib of the first panel and the flange is then housed in the slot.

In a further embodiment the invention provides a roofing panel comprising an elongated rectangular body section the first and second longitudinal edges of which are profiled to form first and second upstanding ribs; wherein the profile of the first rib comprises the first longitudinal edge being turned back on itself at 180 degrees to form a slot, then extending upwardly to form a first upstanding side, then extending outwardly of the body section in a plane approximately parallel to the plane of the body section to a point beyond the extremity of the slot to form a top section, then extending downwardly to the plane of the body section to form a second upstanding side, and finally turning outwardly to form an edge flange in the plane of the body section; wherein the profile of the second rib comprises the second longitudinal edge being turned upwardly to form a first upstanding side, then being turned outwardly to form a top section in approximately the plane of the top section of the first rib, then being turned downwardly to approximately the plane of the body section to form a second upstanding side, and finally being turned inwardly to form an inside flange within the rib in approximately the plane of the body member; and wherein the dimensions of the ribs are chosen such that a second rib of a first panel can be snap fitted over a first rib of an adjacent panel with the inside flange of the second rib of the first panel within the slot of the first rib of the adjacent panel.

BRIEF SUMMARY OF THE DRAWINGS

In drawings which illustrate embodiments of the invention.

Figure 1:
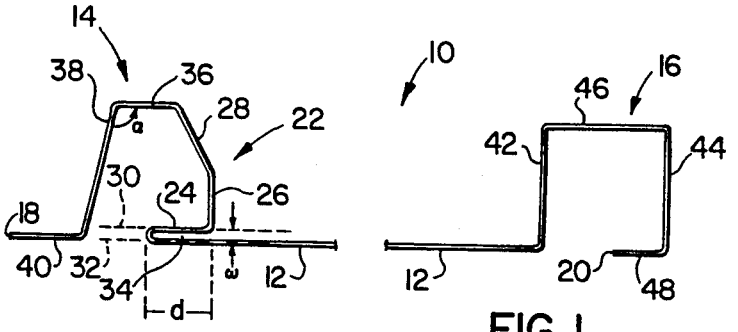
FIG. 1 is a cross section through a panel according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
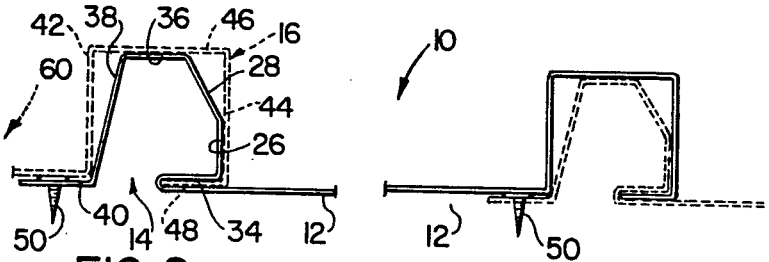
FIG. 2 illustrates edge joints between two panels utilizing the invention.

The embodiment illustrated in FIGS. 1 and 2 of the drawings illustrates a panel 10 comprising an elongated body section or sheet 12 and first and second upstanding ribs 14 and 16 respectively.

The panel 10 is preferably made of light metal.

For reference purposes the inner sides of ribs 14 and 16 are those toward sheet 12 and the outer sides of those ribs are those adjacent the edges 18 and 20 respectively of panel 10.

The first rib 14 includes an inner side 22 comprising a bottom section 24, upstanding section 26 and shoulder section 28. The bottom section 24 of side 22 of rib 14 is formed by bending the sheet 12 over in a plane 30 which is substantially parallel to the plane 32 of sheet 12. There is thus formed a slot 34 between bottom section 24 and sheet 12.

The rib 14 is completed by a top section 36 and a sloped outer side 38. The side 38 forms an obtuse angle $\alpha$ with the top section 36.

The rib 14 is preferably spaced from the edge 18 of sheet 12 to provide an outwardly extending flange 40 substantially in the plane 32 of sheet 12.

The depth d of slot 34 is typically about 15 millimeters. In this embodiment the width w of slot 34 is preferably about 2 millimeters.

In the embodiment of FIGS. 1 and 2 the second rib 16 is preferably of rectangular cross section comprising inner and outer upstanding walls 42 and 44 respectively joined by a top section 46. A bottom section 48 of wall 44 is formed inwardly at approximately the plane of sheet 12 to form the inwardly extending flange 48. In the preferred case the plane of flange 48 is slightly below the plane of sheet 12 to facilitate the rise of sheet 12 over screws 50 as illustrated in FIG. 2.

In use a first panel 10 or a modified edge panel is secured in place at a roof edge such that the edge 18 and rib 14 of panel 10 are remote from the roof edge. The edge 18 of panel 10 is then secured in position by inserting fasteners such as screws through the flange 40 and into the roof. A second panel 60 is then brought into position and the second rib 16 of the panel 60 is snapped down over the first rib 14 of panel 10 such that the inwardly extending flange 48 of rib 16 of panel 60 is positioned within the slot 34 in first rib 14 of panel 10. The edge 18 (not shown) of panel 60 is then in turn secured in place by screws and an adjacent panel then snapped into position as described above. This process goes on until the roof is complete.

The use of the deep slot 34 provides several distinct advantages over any similar structures which have been proposed to date. The very definite snap fit combined with the depth of slot provide for an exceptionally strong joint. As well, the size and configuration of the slot at the bottom of a relatively high rib structure provide an exceptional weather proofing capability, since they allow for the very substantial isolation of the edge 18 of the sheet and the openings into the roof made by the fasteners 50. The height of ribs 14 and 16; e.g., of wall section 44 is typically about 36 millimeters.

Furthermore, the joint is very easily assembled and presents a very smooth finished appearance.

The ribs 14 and 16 and flanges 40 and 48 are readily roll formable.

Figure 3:
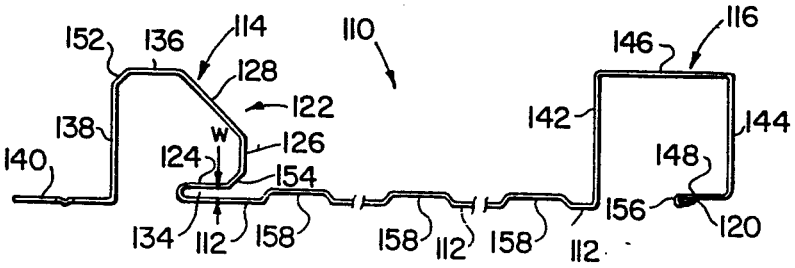
FIG. 3 is a cross section of a further embodiment of a panel according to the invention.
Figure 4:
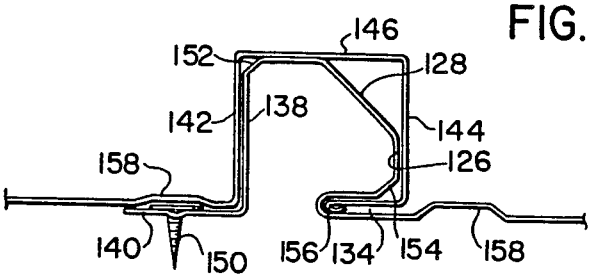
FIG. 4 is a cross section through a joint between two of the panels of FIG. 3.

A preferred configuration of panel 110 is illustrated in FIGS. 3 and 4. In that figure the first rib 114 includes a vertically oriented outer side 138 and a somewhat more elongated sloped shoulder 128 of inner side 122. Furthermore, a short bevelled shoulder 152 is interposed between outer side 138 and top section 136; and a short bevelled section 154, between bottom section 124 and upstanding section 126 of inner side 122. This preferred modified configuration gives advantages in snapping the rib 16 onto the rib 14.

The width w of slot 134 is also somewhat greater in this embodiment, preferably in the order of 3 millimeters.

Finally in respect of this edge of panel 110, the flange 140 is somewhat wider.

The second rib 116 is modified in the FIG. 3 and 4 embodiment in that the inner edge 120 of the inwardly extending flange 148 is turned downwardly and back on itself to form a longitudinal bead 156 beneath flange 148. The beaded portion of flange 148 has an overall height less than width w of slot 134.

When the rib 116 is snapped in place over an adjacent rib 114 in this embodiment, the bead 156 provides additional holding power and resistance to removal from the slot 134.

The FIGS. 3 and 4 embodiment also illustrates a series of low stiffening or reinforcing channels 158. The channel 158 adjacent rib 116 is located to lie above flange 140 of channel 114 so that the heads of a series of screws 150 securing the panel 110 to a roof are accommodated within the channel 158.

Thus it is apparent that there has been provided in accordance with the invention a roofing panel that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modification and variations as fall within the spirit and broad scope of the invention.

What I claim as my invention:

1. A roofing panel for application with its longitudinal direction in the direction of slope of a roof, said panel comprising an elongated thin rectangular body section having first and second longitudinal edges and respective first and second longitudinal upstanding ribs of inverted channel configuration adjacent said edges, said first and second ribs being of substantially the same height, and of substantially the same width at the bottom of the upstanding parts thereof, and a central portion extending between said ribs and configured to extend parallel to said roof;

wherein said first rib has an inner side thereof remote from said first longitudinal edge, the bottom section of said inner side is formed to a position approximately parallel to said central portion and spaced therefrom to form an inwardly facing slot adjacent said central portion, and said slot extends a substantial distance into the interior of said first rib, and wherein said second rib has a first outer side the bottom section of which includes said second edge and which bottom section is formed to a position substantially coplanar with said central portion to form an inwardly facing flange;

whereby when a first said panel is placed adjacent a second said panel, said second rib of said second panel fits over said first rib of said first panel and said flange is then housed in said slot.

2. The panel of claim 1 wherein each said rib includes inner sides remote from said edges, outer sides adjacent said edges, and top sections joining said sides.

3. The panel of claim 2 wherein the dimensions of said ribs are chosen such that one said second rib of one said panel will fit over an adjacent said first rib of a second said panel in a snap fit.

4. The panel of claim 1 wherein said second edge is formed in an open bend back under said flange to thereby form a longitudinal bead under the edge of said flange.

5. The panel of claim 4 wherein the height of said bead is less then the height of said slot.

6. The panel of claim 1 wherein said first rib is spaced from said first longitudinal edge to thereby leave a longitudinal flange at said edge.

7. The panel of claim 1 wherein said first rib, apart from said slot, is of rectangular transverse section but having its upper corners bevelled.

8. The panel of claim 7 wherein that upper corner of said first rib above said slot is bevelled over a substantial part of said cross section to form an elongated sloped shoulder.

9. The panel of claim 1 wherein said second rib is of rectangular transverse section.

10. The panel of claim 1 wherein said body section includes at least one low longitudinal reinforcing channel.

11. The panel of claim 10 including a series of spaced said channels.

12. A roofing panel for application with its longitudinal direction in the direction of slope of said roof, said panel comprising an elongated rectangular body section the first and second longitudinal edges of which are profiled to form first and second upstanding ribs;

wherein the profile of said first rib comprises said first longitudinal edge being turned back on itself at approximately 180 degrees to form a slot, then extending upwardly to form a first upstanding side, then extending outwardly of said body section at a plane approximately parallel to the panel of said body section to a point beyond the extremity of said slot to form a top section, then extending downwardly to the plane of said body section to form a second upstanding side, and finally turning outwardly to form an edge flange in the plane of said body section;

wherein the profile of said second rib comprises said second longitudinal edge being turned upwardly to form a first upstanding side, then being turned outwardly to form a top section in approximately the plane of said top section of said first rib, then being turned downwardly to approximately the plane of said body section to form a second upstanding side, and finally being turned inwardly to form an inside flange within said rib in approximately the plane of said body member; and wherein the dimensions of said ribs are chosen such that a second rib of a first panel can be snap fitted over a first rib of an adjacent said panel with the inside flange of said second rib of said first panel within said slot of said first rib of said adjacent panel.

13. The panel of claim 12 wherein said second upstanding side of said first rib is at an angle greater than 90 degrees to said edge flange.

14. The panel of claim 13 wherein said angle is approximately 102 degrees.

15. The panel of claim 12 wherein the width of said slot is approximately 17 millimeters.

16. The panel of claim 12 wherein said first upstanding side of said first rib comprises a first lower substantially vertical section and a second upper section angled outwardly of said body section.

17. The panel of claim 16 wherein said angle is approximately 28 degrees to the vertical.

18. The panel of claim 12 wherein said first upstanding side of said first rib comprises a first lower substantially vertical section and a second upper section angled outwardly of said body section, and wherein said second upstanding side of said first rib is at an angle greater than 90 degrees to said edge flange.

19. The panel of claim 12 wherein said top section of said second rib is in a plane lower than the plane of the top section of said first rib.

20. The panel of claim 19 wherein said second upstanding member of said second rib terminates at its lower end below the plane of said body section and wherein the plane of said inside flange is below the plane of said body section.

21. The panel of claim 12 wherein said inside flange and said slot are of approximately the same width.

22. The panel of claim 12 wherein the edge of said inside flange is curved downwardly and back on itself to form a longitudinal bead under the edge of said flange.

23. The panel of claim 12 wherein said first rib includes short bevelled sections between said slot and said first upstanding side and between said top and said second upstanding side.

24. A roofing panel for application with its longitudinal direction in the direction of said roof, said panel comprising an elongated thin rectangular body section having first and second longitudinal edges and respective first and second longitudinal upstanding ribs of inverted channel configuration adjacent said edges;

wherein said first rib has an inner side thereof remote from said first longitudinal edge, the bottom section of said inner side is formed to a position approximately parallel to said body section and spaced therefrom to form an inwardly facing slot adjacent said body section, and said first rib is spaced from said first longitudinal edge to leave a flange at said edge; and wherein said second rib has a first outer side the bottom section of which includes said second longitudinal edge, which bottom section is formed to a position substantially parallel to said body section to form an inwardly facing flange and the edge of which inwardly facing flange is formed in an open bend back under said flange to thereby form a longitudinal bead under the edge of said flange;

whereby when a first said panel is placed adjacent a second said panel, said second rib of said second panel snap fits over said first rib of said first panel and said flange is then housed in said slot.

25. The panel of claim 24 wherein an upper corner of said first rib above said slot is bevelled over a substantial part of said cross section.

26. The panel of claim 25 wherein said second rib is of substantially rectangular transverse section.

* * * * *